US010654059B2

(12) United States Patent
LaFlamme et al.

(10) Patent No.: US 10,654,059 B2
(45) Date of Patent: May 19, 2020

(54) SELF SEALING AIRLESS MEASURED DISPENSER

(71) Applicant: 1Touch Holdings, Inc., Farmington, CT (US)

(72) Inventors: Roger J. LaFlamme, Sturbridge, MA (US); Jim Warner, Chicago, IL (US)

(73) Assignee: 1TOUCH HOLDINGS, INC., Farmington, CT (US)

( * ) Notice: Subject to any disclaimer, the term of this patent is extended or adjusted under 35 U.S.C. 154(b) by 9 days.

(21) Appl. No.: 15/941,893

(22) Filed: Mar. 30, 2018

(65) Prior Publication Data

US 2019/0105678 A1 Apr. 11, 2019

Related U.S. Application Data

(60) Provisional application No. 62/478,917, filed on Mar. 30, 2017.

(51) Int. Cl.
*B05B 11/00* (2006.01)
*B65D 75/58* (2006.01)

(52) U.S. Cl.
CPC ..... *B05B 11/3032* (2013.01); *B65D 75/5877* (2013.01); *B05B 11/007* (2013.01); *B05B 11/3069* (2013.01)

(58) Field of Classification Search
CPC ..... B05B 11/3032; B05B 11/007; B05B 11/3069; B65D 75/5877
USPC ..... 222/105
See application file for complete search history.

(56) References Cited

U.S. PATENT DOCUMENTS

| | | | | |
|---|---|---|---|---|
| 7,980,424 | B2 * | 7/2011 | Johnson | B65D 75/5877 222/105 |
| 7,984,831 | B2 | 7/2011 | Kanfer et al. | |
| 8,240,518 | B2 | 8/2012 | Canfield | |
| 8,292,120 | B2 | 10/2012 | LaFlamme et al. | |
| 2007/0080177 | A1 | 4/2007 | Hatton et al. | |

(Continued)

OTHER PUBLICATIONS

International Search Report issued in co-pending International Application No. PCT/US18/25490 dated Jul. 2, 2018.

*Primary Examiner* — Donnell A Long
(74) *Attorney, Agent, or Firm* — DeLio Peterson & Curcio LLC; Peter W. Peterson

(57) ABSTRACT

A dispensing device affixed to the outside of a flexible container. A top part of the device includes a pump dome, a pump chamber ridge, and pump chamber flange. A bottom part includes a pump chamber, a pump chamber flange, a neck portion, and a dispensing head having an outlet at the end of a dispensing channel. The dispensing channel and the outlet are situated in a portion of the dispensing head that extends below the plane of the neck portion. The top part is sealed to the bottom part creating a channel between the pump chamber and the dispensing side of the dispenser. The device is sealed to the container in two discrete areas, namely the flange of the pump chamber and the bottom of the distal portion of the dispensing head. The area of the dispensing element between the pump chamber and the distal end of the dispensing head, referred herein as the neck portion, is not sealed to the container, causing the neck portion of the dispensing device to flex, pinching shut the channel that connects the pump chamber to the dispensing head.

5 Claims, 6 Drawing Sheets

(56) References Cited

U.S. PATENT DOCUMENTS

| | | | |
|---|---|---|---|
| 2012/0097709 | A1 | 4/2012 | Han De Man et al. |
| 2014/0339266 | A1 | 11/2014 | LaFlamme |

* cited by examiner

SELF SEALING AIRLESS MEASURED DISPENSER

BACKGROUND OF THE INVENTION

Field of the Invention

This invention relates generally to dispensing devices and packages. More specifically, the present invention relates to metering devices that can controllably dispense fluid media from a source of fluid media.

Description of the Background

Various types of fluid material and media are employed for different purposes through commerce and industry. For example, there are various products in the personal care, home care, air care, medical, transportation care, and food industries that require some type of dispensing of a fluid material from a source of such material. When this material is sold in commerce, it must be contained and stored in some type of container. When that product is used, it must be dispensed from its storage container to a location for use.

In the prior art, there are many different types of dispensers for delivering fluid material. For example, a flexible container body with a nozzle tip that includes a separate one-way valve that must be inserted into the nozzle to prevent drip or contamination is commonly provided for such a purpose. An application of such use is for the dispensing of ketchup where the container body is squeezed by the user to urge the fluid material out from the nozzle tip and accurately to a desired location. The amount of fluid delivered is determined by the how much the user squeezed the container body. However, this yields erratic results where more or less fluid material is delivered on each successive squeeze of the container body. Also, the container must be held upright to avoid leakage because no valves are employed.

In another example of a prior art dispensing device, a flexible container holds a volume of fluid material to be delivered. A single one-way check valve is provided as an exit port from the flexible container. When the flexible body is squeezed, the material is urged out under pressure through the valve.

SUMMARY OF THE INVENTION

The present invention preserves the advantages of prior art dispensing devices. In addition, it provides new advantages not found in currently available devices and overcomes many disadvantages of such currently available devices.

The invention is generally directed to a novel and unique dispenser for delivering a measured dose of fluid material upon each dispensing operation with an optional applicator for even distribution of the dispensed fluid material. The invention also incorporates a self-sealing feature that prevents drips and contamination.

The invention includes a dispensing device affixed to the outside of a container, preferably a flexible bag. The dispensing device has a top part and a bottom part. The top part includes a pump dome, a pump chamber ridge, and pump chamber flange, a portion of which extends away from the center of the pump chamber dome in a projection or "neck." The bottom part includes a pump chamber, a pump chamber flange, a neck portion, and a dispensing head having an outlet at the end of a dispensing channel. The dispensing channel and the outlet are situated in a portion of the dispensing head that extends below the plane of the neck portion.

The top part is sealed to the bottom part along the entirety of the periphery of the top part, creating a first channel between the pump chamber and the dispensing side of the dispenser, which first channel is in liquid communication with a second channel (the dispensing channel) integrally formed in the bottom side via a first port. The second channel leads to an outlet at one end of the dispensing device. The pump chamber has a second port through its bottom surface for allowing movement of fluid into the pump chamber from the container upon action of the pump dome.

The underside of the bottom part of pump chamber flange of the dispensing device is sealed to the container along the perimeter of an opening or hole in the container, which opening or hole preferably has a shape and diameter that is approximately the same as the inside diameter of the pump chamber flange or the outside diameter of the pump chamber.

The container is preferably a flexible bag made of thin film material. According to a preferred embodiment, the container is a flexible bag made of two sheets of thin film material sealed to one-another along their respective peripheries.

In addition to being sealed to the container at its opening, the dispensing device is also sealed to the outside surface of the container at the bottom surface of the distal end of the dispensing side ("the dispensing head") of the dispenser.

Sealing of the dispensing element to the container is discontinuous. That is, the dispensing element is sealed to the container in two discrete areas, namely the flange of the pump chamber and the bottom of the distal portion of the dispensing head. The area of the dispensing element between the pump chamber and the distal end of the dispensing head, referred herein as the neck portion, is not sealed to the container.

When the dispensing element is sealed to the top film of the container, the dispensing head portion of the bottom of the dispensing element extends below the plane of the pump chamber flange. This geometry, coupled with the discontinuous sealing of the top film of the container to the dispensing element causes the neck portion of the dispensing device to flex when the container is filled with fluid causing the rigid bottom portion to flex out of its planar orientation/conformation, pinching shut the channel that connects the pump chamber to the first port and which is formed in the neck when the top part is sealed to the bottom part, effectively creating a valve without additional valve structure, i.e., a "pinch valve."

Pressing the pump chamber dome forces liquid from the pump chamber into the neck channel, through the pinch valve and ultimately out the dispensing head through the outlet, but when the pump chamber is not being activated, the geometry of the device forces the channel closed at the pinch valve, preventing the leaking of undesired fluid from the outlet. While fluid resides in the distal portion of the neck channel and in the channel that traverses the dispensing head, that fluid is held in place by vacuum due to the narrow diameter of the passage.

DETAILED DESCRIPTION

Figure 1:
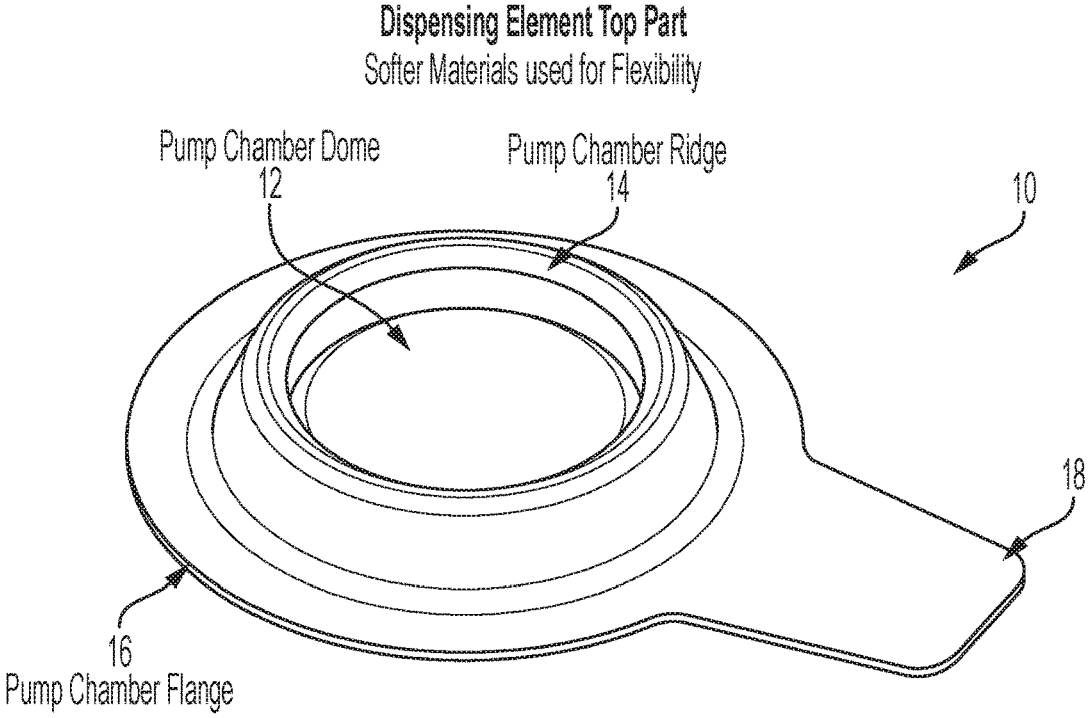
FIG. 1 is a perspective view of a top part of a dispensing device according to an embodiment of the invention.
Figure 2:
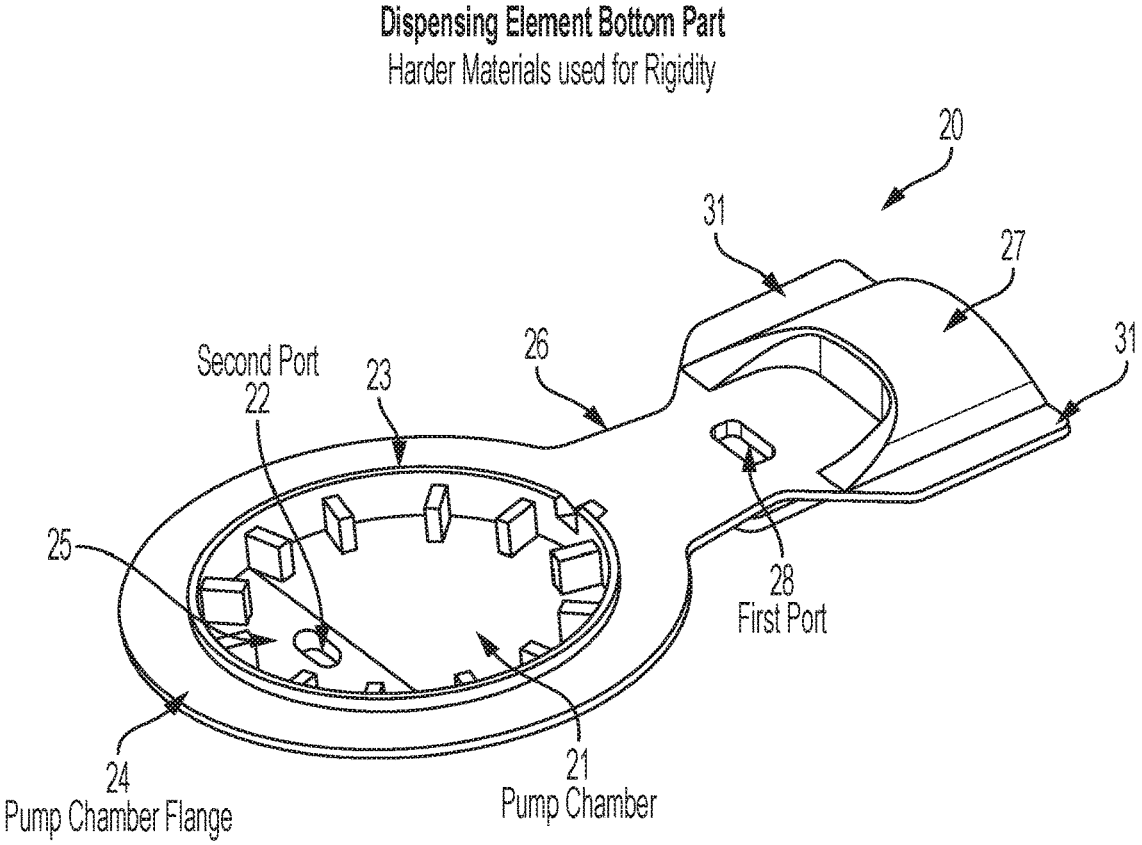
FIG. 2 is a perspective view of a bottom part of a dispensing device according to an embodiment of the invention.
Figure 3:
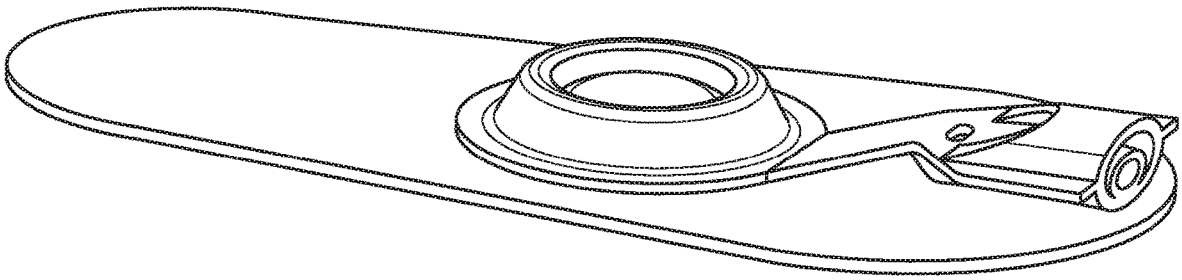
FIG. 3 is a representation of a perspective view of a dispensing device attached to a top surface of a container according to an embodiment of the invention.
Figure 4:
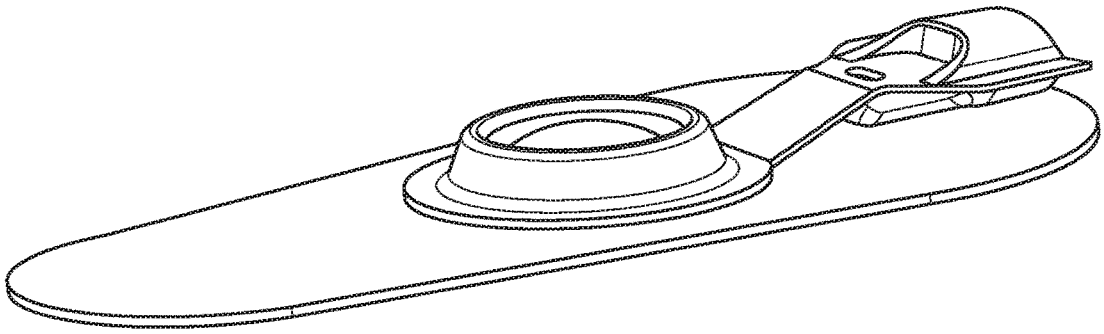
FIG. 4 is a perspective view drawing of a dispensing device attached to a top surface of a container according to an embodiment of the invention.
Figure 5:
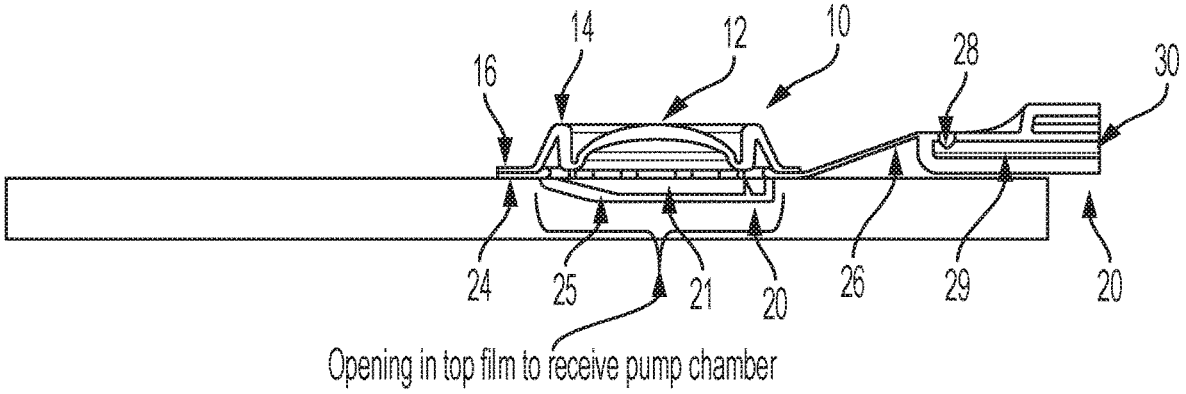
FIG. 5 is a side view drawing of a dispensing device attached to a container according to an embodiment of the invention.
Figure 6:
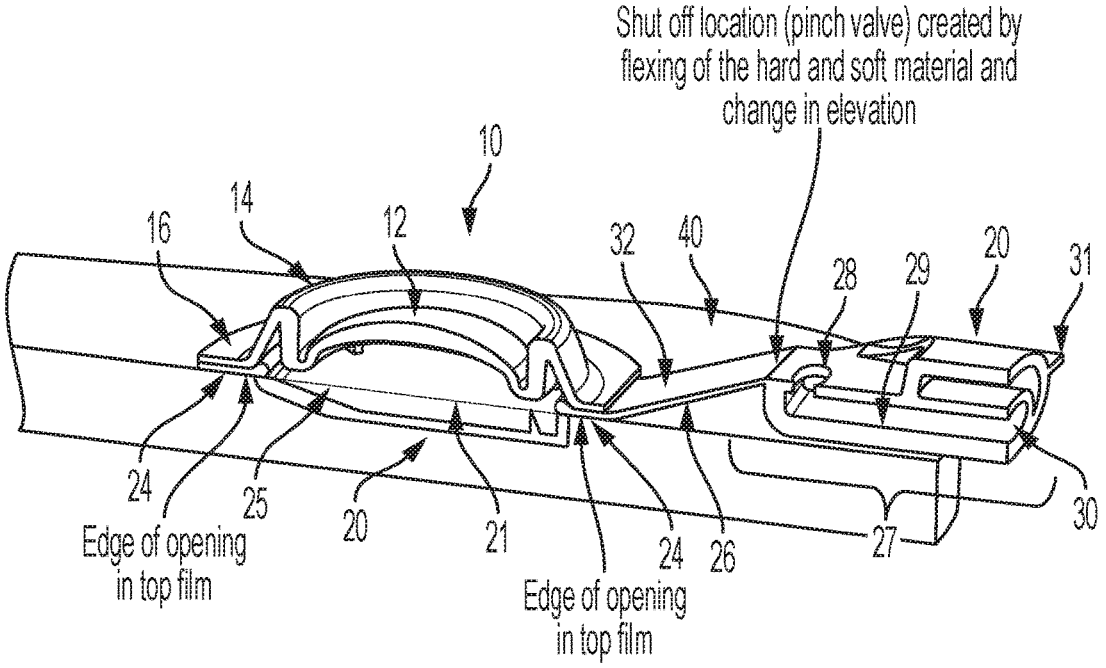
FIG. 6 is a perspective cutaway drawing of a dispensing device attached to a container according to an embodiment of the invention.
Figure 7:
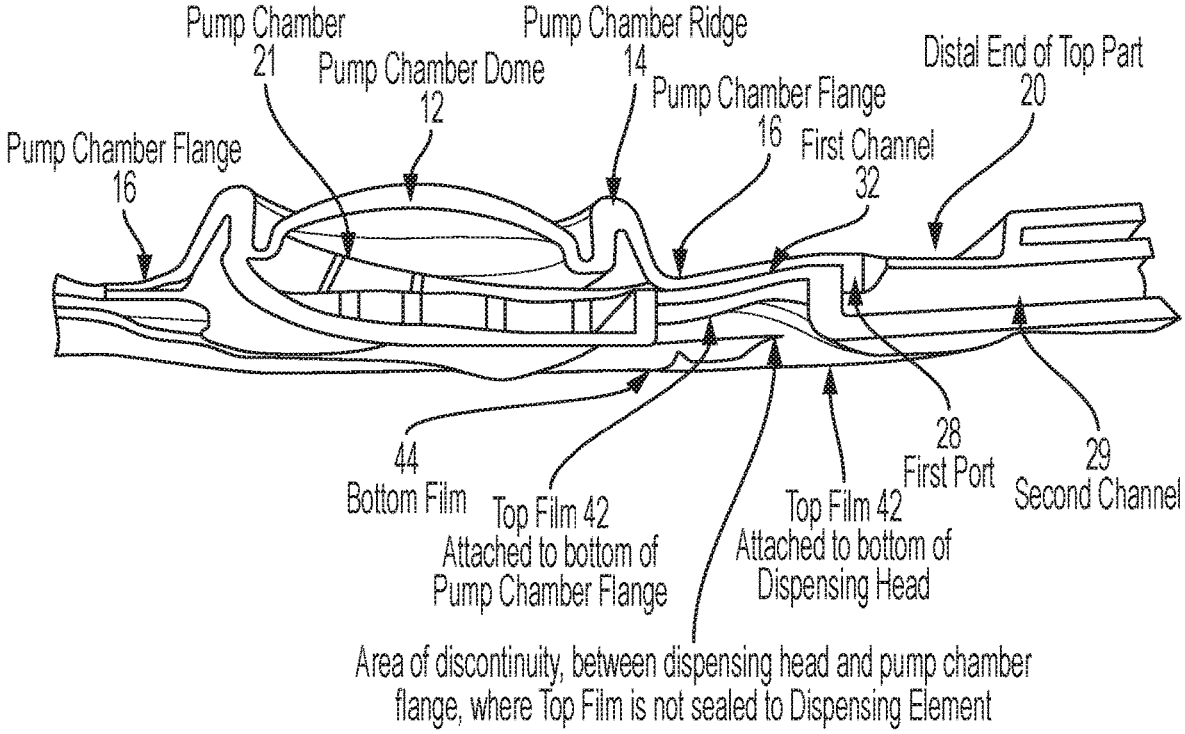
FIG. 7 is a photograph of a dispensing device attached to a container according to an embodiment of the invention which has been sectioned through a longitudinal midline.
Figure 8:
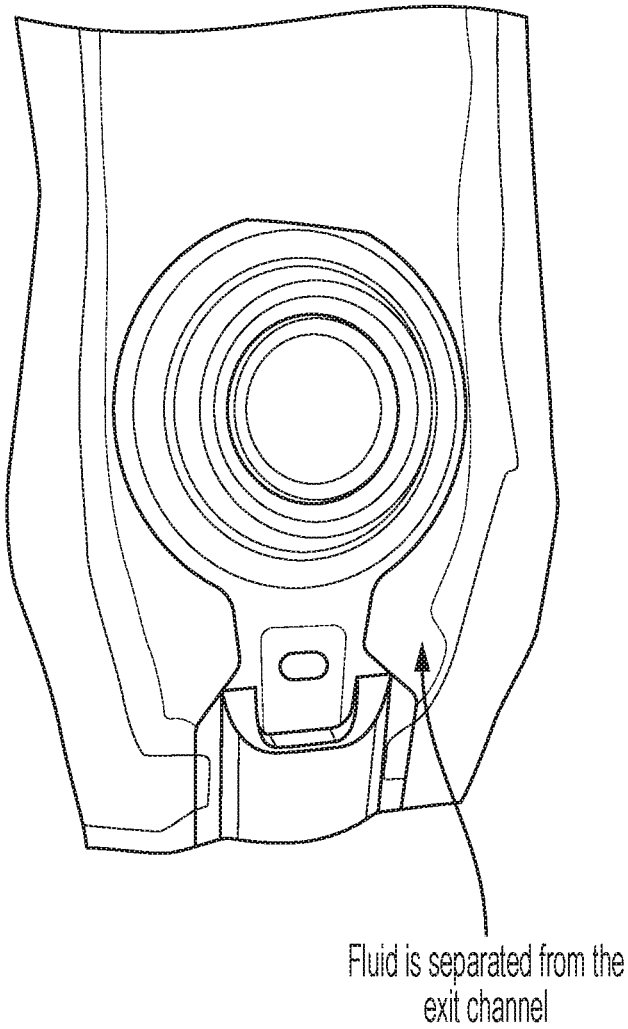
FIG. 8 is a top view photograph of a dispensing device attached to a container according to an embodiment of the invention.

Referring to the figures, the dispensing device 1 of the invention includes a top part 10 and a bottom part 20. The dispensing device is configured for attaching to the surface of liquid or gel container 40. The container 40 is preferably flexible, at least on one side, and more preferably is constructed of upper film 42 and lower film 44 sealed to one-another along their respective peripheries. The container 40 preferably contains little to no air when it is filled with its liquid or gel contents and preferably collapses as it is emptied of its contents. The container preferably has an opening in its flexible surface sized to receive a portion of the bottom part.

Top part 10 of the dispensing device 1 includes a flexible pump chamber dome 12, surrounded by pump chamber ridge 14, which in turn is surrounded by pump chamber flange 16. One portion of pump chamber flange 16 extends away from the center of the pump chamber dome in a top part flange projection 18. The top part is preferably made of flexible elastomeric shape memory material to allow the pump chamber dome to be depressed by a user and then return to its original shape when released. The top part is preferably molded as a single unit.

The bottom part 20 of dispensing device 1 includes pump chamber 21 having a receiving port 22 for receiving liquid/gel from container 40. The pump chamber is preferably circular in shape and preferably corresponds generally to the shape and size of the pump chamber dome 12. The pump chamber 21 is preferably bound along its periphery by pump chamber lower ridge 23, which in turn is surrounded by annular lower or bottom part pump chamber flange 24. The port 22 may be located on a sloped region 25 of said pump chamber 21. A portion of the bottom part flange may extend away from the center of pump chamber 21 in a bottom part flange projection, extension or neck 26. The bottom part flange projection 26 may be preferably shaped and sized to correspond to the shape and size of top part flange projection 18. Bottom part flange projection 26 however extends past the end of top part flange projection 18 to terminate at dispensing head 27. Dispensing head 27 of the bottom part 20 includes dispensing port 28 on a top surface of said dispensing head 27 in communication with a dispensing channel 29 inside said dispensing head, which opens at an opposite end at outlet 30. The dispensing head may also have lateral flanges or "wing portions" 31 that are preferably co-planar with the interface of said dispensing port 28 with said top surface of said bottom part when the bottom part is not deformed by attachment to a fluid-filled container. The bottom part is preferably constructed of more rigid material than the top part, and may be preferably molded as a single integrated unit.

The dispensing device 1, is constructed by affixing the bottom surface of said pump chamber flange 16 to a top surface of said bottom part flange 24, including affixing a bottom surface of said top part flange projection 18 to a top surface of said bottom part flange projection 26, leaving a delivery channel 32 between said top and bottom portions along a central axis thereof between said pump chamber/pump chamber dome and said dispensing port 28. The distal end of the top part flange projection may terminate just beyond the location on the bottom part of the dispensing or delivery port 28.

The assembled dispensing device 1 is affixed to container 40 by inserting the pump chamber portion 21 of the bottom part 20 into a correspondingly sized and shaped opening in a flexible surface of said container. The container is then sealed to the bottom surface of said bottom part flange, optionally including a proximate portion of said bottom part flange projection, and to a bottom surface of said dispensing head. However, according to a critical feature of the invention, an area of discontinuity or lack of attachment between the container 40 and the dispensing device is provided at a region of the bottom flange projection that is proximate to (before) the dispensing head. This region of discontinuity (no connection between the dispensing device and the container) may be just the last 2-3 millimeters before the dispensing head, or it may be all or nearly all of the portion of the flange projection between the dispensing head and the pump chamber flange.

When the dispensing element is sealed to the top film of the container, the dispensing head portion of the bottom of the dispensing element, in particular the portion containing the dispensing channel, extends below the plane of the pump chamber flange due to the rigidity of the bottom part. Accordingly, the bottom part must be sufficiently rigid to maintain this conformation while at rest/not under force. The geometry of the dispensing device, coupled with the discontinuous sealing of the top film of the container to the bottom part of the dispensing device causes the neck portion of the dispensing device (formed by the top and bottom flange extensions) to flex, pinching shut the channel that connects the pump chamber to the first port and which is formed in the neck when the top part is sealed to the bottom part, effectively creating a valve without additional valve structure, i.e., a "pinch valve."

In operation, when a user presses the pump chamber down into the pump chamber, the contents of the dome are forced from the pump chamber into the neck channel, through the pinch valve, the pressure from the user's thumb or finger overcoming the forces that pinch the channel shut, and the fluid is pushed out the dispensing head through the outlet via the delivery port and delivery channel. When the pump chamber is not being activated, however, the geometry of the device forces the channel closed at the pinch valve, preventing the leaking of undesired fluid from the outlet. While fluid resides in the distal portion of the neck channel and in the channel that traverses the dispensing head, that fluid is held in place by vacuum due to the narrow diameter of the passage.

Figure 9:
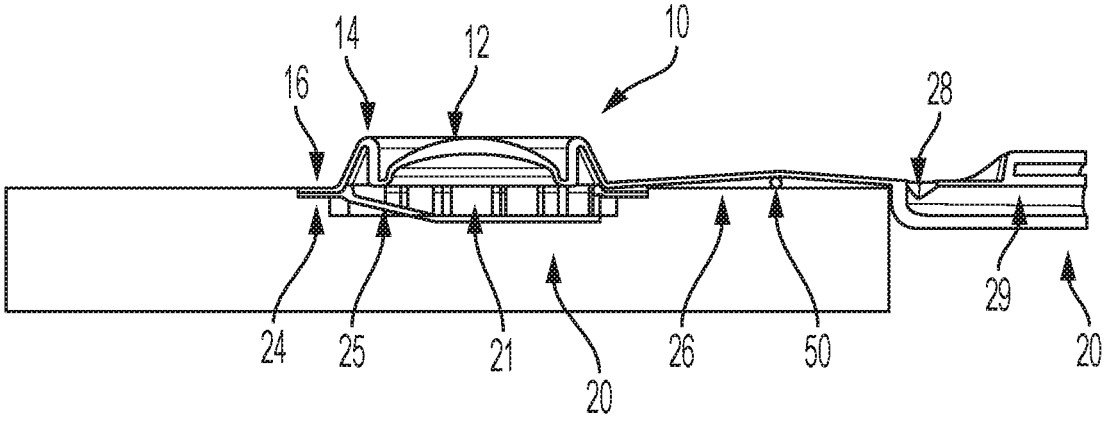
FIG. 9 is a side view drawing of a dispensing device attached to a container according to another embodiment of the invention.

According to an alternative embodiment, the bottom of the dispensing head extends past the edge of the container as shown in FIG. 9. According to this embodiment, the location of dispensing head is no longer on top of the container and thus no longer causes a pinch in the delivery channel. Instead, a nub or other feature 50 is molded or otherwise provided on the bottom side of the bottom part flange projection 26. No discontinuity of connection is required for the proper operation of this embodiment. The dispensing device may optionally be affixed to the container throughout its entire bottom surface (except for the dispensing head, which extends past the edge of the container) for a very secure connection. When the dispensing device is fixed to the container, the fluid in the container forces the nub upward, pinching the delivery channel shut with sufficient force to prevent leaking. User activation of the pump chamber provides sufficient force to urge fluid past the pinch valve, through the delivery port, dispensing channel and outlet.

According to further alternative embodiment, the pinching element may be provided on the container or between the container and the delivery device.

The invention claimed is:

1. A liquid dispensing device comprising:

a container having a flexible surface;

an elastomeric shape memory top part having a pump chamber dome, an annular pump chamber ridge around a periphery of said pump chamber dome, and a planar top part pump chamber flange around a periphery of said annular pump chamber ridge, a portion of the pump chamber flange extending away from a center of said pump chamber dome in a pump chamber flange extension;

a rigid bottom part having a circular pump chamber portion and a dispensing head portion connected by a neck portion, said dispensing head portion defining a delivery port on a top side thereof proximate said neck portion, said pump chamber portion having an annular lower part pump chamber flange, said rigid bottom part connected to an exterior of the flexible container surface along a bottom surface of said annular lower part pump chamber flange, with a portion of the rigid bottom part extending through an opening in and below the flexible container surface;

a fluid outlet at a distal end of said dispensing head portion, and a dispensing channel connecting said delivery port and said fluid outlet;

wherein said neck portion is an extension of said annular lower part pump chamber flange; and said annular lower part pump chamber flange and said neck portion are co-planar in an unstressed state, said top part connected to said bottom part along a periphery of said planar top part pump chamber flange and said pump chamber flange extension to define a channel between said pump chamber and said delivery port adjacent to and above the flexible container surface.

2. A liquid dispensing device according to claim 1, wherein a bottom surface of said dispensing head portion is connected to the exterior of the flexible container surface, and further comprising a region of discontinuity where at least a portion of said neck portion is not connected to said container.

3. A liquid dispensing device according to claim 2, wherein said region of discontinuity and a rigidity of said bottom portion creates a pinch valve in said channel between said pump chamber and said delivery port.

4. A liquid dispensing device according to claim 1, wherein a portion of said dispensing head containing said dispensing channel is not co-planar with said lower part pump chamber flange and said neck portion.

5. A liquid dispensing device according to claim 1, wherein said dispensing head comprises lateral flanges co-planar with said neck and said lower part annular pump chamber flange when said lower part is not under stress.

* * * * *